US008207810B2

(12) United States Patent
Kawabata

(10) Patent No.: US 8,207,810 B2
(45) Date of Patent: Jun. 26, 2012

(54) MULTILAYER ELECTRONIC COMPONENT

(75) Inventor: Toshio Kawabata, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/795,441

(22) Filed: Jun. 7, 2010

(65) Prior Publication Data

US 2010/0245013 A1 Sep. 30, 2010

Related U.S. Application Data

(63) Continuation of application No. PCT/JP2008/071421, filed on Nov. 26, 2008.

(30) Foreign Application Priority Data

Dec. 7, 2007 (JP) ..... 2007-316997

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/222, 223
See application file for complete search history.

(56) References Cited

U.S. PATENT DOCUMENTS

| | | | | |
|---|---|---|---|---|
| 5,250,923 | A * | 10/1993 | Ushiro et al. | 336/83 |
| 6,459,351 | B1 * | 10/2002 | Maki et al. | 336/200 |
| 2004/0108934 | A1 * | 6/2004 | Choi et al. | 336/200 |
| 2008/0012679 | A1 * | 1/2008 | Okabe et al. | 336/200 |

FOREIGN PATENT DOCUMENTS

| | | | |
|---|---|---|---|
| JP | 1-196113 | | 8/1989 |
| JP | 3-251-370 | | 11/1991 |
| JP | 4-284612 | A | 10/1992 |
| JP | 6-036921 | A | 2/1994 |
| JP | 9-082568 | | 3/1997 |
| JP | 2002-208515 | A | 7/2002 |
| JP | 2005-093971 | A | 4/2005 |
| JP | 2005-123450 | A | 5/2005 |
| JP | 2006-093511 | A | 4/2006 |
| JP | 2006-093514 | A | 4/2006 |
| JP | 2006-253245 | A | 9/2006 |

(Continued)

OTHER PUBLICATIONS

English translation of JP2002-118033.*

(Continued)

*Primary Examiner* — Mohamad Musleh
*Assistant Examiner* — Ronald Hinson
(74) *Attorney, Agent, or Firm* — Studebaker & Brackett PC; Tim L. Brackett, Jr.; John F. Guay

(57) ABSTRACT

A multilayer electronic component is provided which includes layers composed of different materials and bonded together and which is capable of suppressing the occurrence of delamination at a bonded portion between the layers composed of different materials. A magnetic first layer is composed of a material with relatively high magnetic permeability. A second magnetic layer is composed of a material with relatively low magnetic permeability. Boundary magnetic layers are provided between the two magnetic layers and include a partial magnetic layer composed of the same material as the first magnetic layer and a partial magnetic layer composed of the same material as the second magnetic layer. The partial magnetic layers are provided to be adjacent to each other in the boundary magnetic layers.

17 Claims, 4 Drawing Sheets

FOREIGN PATENT DOCUMENTS

KR 10-2004-0047452 6/2004

OTHER PUBLICATIONS

Enlish translation of JP2005093971.*

International Search Report; PCT/JP2008/071421; Feb. 24, 2009.
S.Kondo; "Written Opinion of the International Searching Authority"; PCT/JP2008/071421; Feb. 24, 2009.
The Korean Office Action issued on Jun. 24, 2011; Korean Patent Application No. 2010-7011089 with abstract.

* cited by examiner

MULTILAYER ELECTRONIC COMPONENT

CROSS REFERENCE TO RELATED APPLICATION

The present application is a continuation of International Application No. PCT/JP2008/071421 filed Nov. 26, 2008, which claims priority to Japanese Patent Application No. 2007-316997 filed Dec. 7, 2007, the entire contents of each of these applications being incorporated herein by reference in their entirety.

BACKGROUND

1. Field of the Invention

The present invention relates to a multilayer electronic component and particularly to a multilayer electronic component in which a first insulating layer and a second insulating layer are laminated.

2. Description of the Related Art

There have been proposed multilayer electronic components including inductance and having various frequency characteristics. For example, Japanese Unexamined Patent Application Publication No. 2002-208515 has proposed a multilayer inductor including a laminate of high-permeability magnetic layers including a coil and a laminate of low-permeability magnetic layers including a coil. The multilayer inductor is capable of achieving a steep impedance characteristic at a low frequency and high impedance at a high frequency.

However, the multilayer inductor described in Japanese Unexamined Patent Application Publication No. 2002-208515 has the problem of delamination. Moreover, the multilayer inductor includes the laminates composed of different materials, and, thus, has weak bonding strength between the laminates. Therefore, delamination easily occurs between the laminates.

In addition, Japanese Patent No. 3251370 describes a composite multilayer component including an intermediate layer containing nonmagnetic ferrite and provided for preventing the precipitation of Cu and Cu oxides, Zn and Zn oxides, and the like at an interface between different materials. However, Japanese Patent No. 3251370 does not mention that the occurrence of delamination at an interface between different materials is prevented.

SUMMARY

Embodiments consistent with the claimed invention can provide a multilayer electronic component which includes layers composed of different materials and bonded together and which is capable of suppressing the occurrence of delamination at a bonded portion between the layers composed of different materials.

A multilayer electronic component according to an embodiment includes a first insulating layer composed of a first material, a second insulating layer composed of a second material different from the first material, and a boundary layer provided between the first insulating layer and the second insulating layer and including a first partial layer composed of the first material and a second partial layer composed of the second material, wherein the first partial layer and the second partial layer are provided to be adjacent to each other as viewed in a lamination direction.

According another exemplary embodiment, in the boundary layer provided between the first insulating layer and the second insulating layer, the first partial layer and the second partial layer are adjacent to each other. Therefore, the first partial layer and the second partial layer are in contact with each other through the side surfaces. As a result, the contact area between the insulating layers composed of different materials can be increased, thereby suppressing the occurrence of delamination in the multilayer electronic component.

In another exemplary embodiment, the first partial layer may be provided so that the area of contact with the second insulating layer is larger than that with the first insulating layer.

In another exemplary embodiment, the boundary layer includes a first boundary layer provided on the first insulating layer side and a second boundary layer provided on the second insulating layer side, and the area of the first partial layer provided in the second boundary layer may be larger than the area of the first partial layer provided in the first boundary layer.

In to another exemplary embodiment, a plurality of the first insulating layers may be laminated to form a first laminate, and a plurality of the second insulating layers may be laminated to form a second laminate.

In another exemplary embodiment, the first laminate and the second laminate include a coil.

In another exemplary embodiment, the first partial layer and the second partial layer may be arranged in a checked pattern in the boundary layer.

According to embodiments consistent with the claimed invention, in a boundary layer disposed between a first insulating layer and a second insulating layer, a first partial layer and a second partial layer are provided to be adjacent to each other. Therefore, the first partial layer and the second partial layer are in contact with each other through the side surfaces. As a result, the contact area between the insulating layers composed of different materials can be increased, thereby suppressing the occurrence of delamination in the multilayer electronic component.

Other features, elements, characteristics and advantages of the embodiments consistent with the claimed inventions will become more apparent from the following detailed description with reference to the attached drawings.

DETAILED DESCRIPTION

Figure 1:
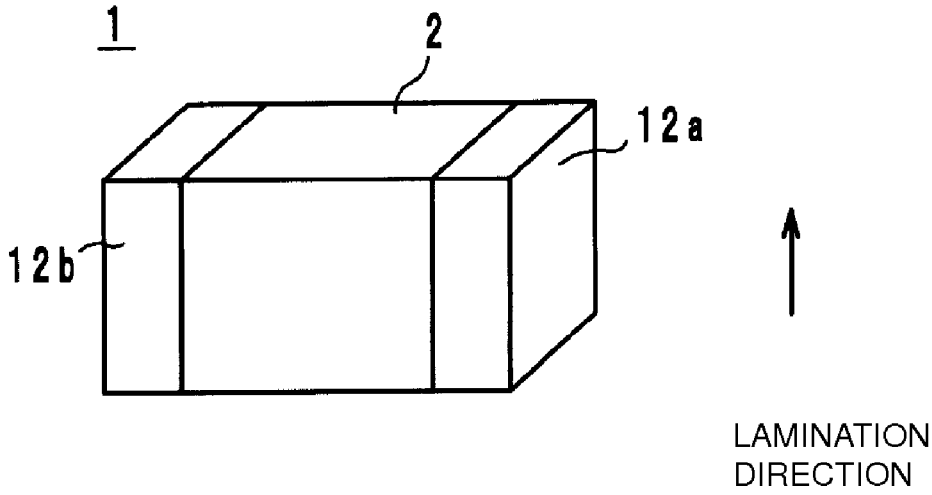
FIG. 1 is a perspective view of the appearance of a multilayer electronic component according an exemplary embodiment consistent with the claimed invention.
Figure 2:
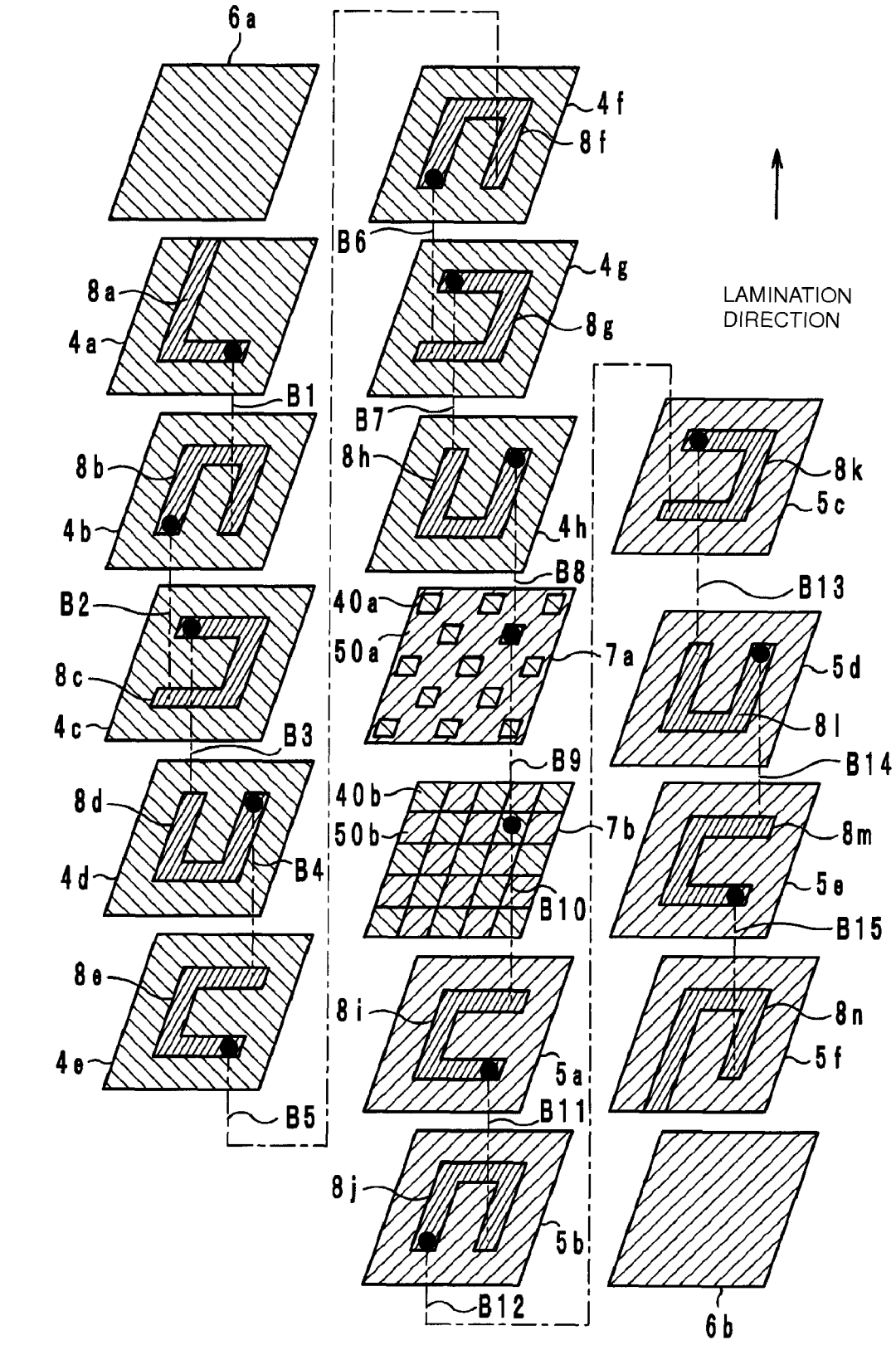
FIG. 2 is an exploded perspective view of a laminate.

A multilayer electronic component according an exemplary embodiment is described below. The multilayer electronic component is used for, for example, an inductor, an impeder, a LC filter, and a LC composite component. FIG. 1 is a perspective view of the appearance of a multilayer electronic component 1, and FIG. 2 is an exploded perspective view of a laminate 2. Hereinafter, the direction in which ceramic green sheets are laminated when the multilayer electronic component 1 is formed is defined as the lamination direction.

As shown in FIG. 1, the multilayer electronic component 1 includes the laminate 2 having a rectangular parallelepiped shape and including a coil L therein, and two external electrodes 12*a* and 12*b* formed on the opposite sides (surfaces) of the laminate 2 and connected to the coil L.

The laminate 2 is realized by laminating a plurality of coil electrodes and a plurality of magnetic layers. Specifically, as shown in FIG. 2, the laminate 2 is realized by laminating a plurality of magnetic layers 4*a* to 4*h*, 5*a* to 5*f*, 6*a*, 6*b*, 7*a*, and 7*b* composed of high-permeability ferrite (e.g., Ni—Zn—Cu ferrite, Ni—Zn ferrite, or the like). The plurality of magnetic layers 4*a* to 4*h*, 5*a* to 5*f*, 6*a*, 6*b*, 7*a*, and 7*b* are rectangular insulating layers having substantially the same area and shape.

The magnetic layers 4*a* to 4*h* are composed of a material having relatively high permeability. In addition, coil electrodes 8*a* to 8*h* constituting the coil L are formed on the main surfaces of the magnetic layers 4*a* to 4*h*, respectively. Further, via hole conductors B1 to B8 are formed in the magnetic layers 4*a* to 4*h*, respectively.

The magnetic layers 5*a* to 5*f* are composed of a material different from that of the magnetic layers 4*a* to 4*h*. In more detail, the magnetic layers 5*a* to 5*f* are composed of a material having relatively low permeability. In addition, coil electrodes 8*i* to 8*n* constituting the coil L are formed on the main surfaces of the magnetic layers 5*a* to 5*f*, respectively. Further, via hole conductors B11 to B15 are formed in the magnetic layers 5*a* to 5*e*, respectively.

The magnetic layer 6*a* is composed of the same material as that of the magnetic layers 4*a* to 4*h*. The magnetic layer 6*b* is composed of the same material as that of the magnetic layers 5*a* to 5*f*. The coil electrodes 8*a* to 8*n* on the main surfaces and the via hole conductors B1 to B15 are not formed in the magnetic layers 6*a* and 6*b*.

The magnetic layers 7*a* and 7*b* are boundary layers provided between the magnetic layer 4*h* and the magnetic layer 5*a*. In further detail, the magnetic layer 7*a* is provided on the magnetic layer 4*h* side. On the other side, the magnetic layer 7*b* is provided on the magnetic layer 5*a* side. The configurations of the magnetic layers 7*a* and 7*b* are described in further detail below.

The magnetic layer 7*b* includes partial magnetic layers 40*b* and 50*b*. The partial magnetic layer 40*b* is composed of the same material as that of the magnetic layers 4*a* to 4*h*. The partial magnetic layer 50*b* is composed of the same material as that of the magnetic layers 5*a* to 5*f*. The partial magnetic layer 40*b* and the partial magnetic layer 50*b* are formed to be adjacent to each other as viewed from the lamination direction.

More specifically, the partial magnetic layer 40*b* and the partial magnetic layer 50*b* are formed in a square shape of the same size and arranged in a checked pattern. In other words, the partial magnetic layer 50*b* is in contact with each of the sides of the partial magnetic layer 40*b*, and the partial magnetic layer 40*b* is in contact with each of the sides of the partial magnetic layer 50*b*.

On the other hand, the magnetic layer 7*a* includes partial magnetic layers 40*a* and 50*a*. The partial magnetic layer 40*a* is composed of the same material as that of the magnetic layers 4*a* to 4*h*. The partial magnetic layer 50*a* is composed of the same material as that of the magnetic layers 5*a* to 5*f*.

The partial magnetic layer 40*a* and the partial magnetic layer 50*a* are formed to be adjacent to each other as viewed from the lamination direction. More specifically, the partial magnetic layer 40*a* is formed in a square shape having an area slightly smaller than that of the partial magnetic layer 40*b* and is disposed to overlap the partial magnetic layer 40*b* when the magnetic layer 7*a* and the magnetic 7*b* overlap each other. Further, the partial magnetic layer 50*a* is formed to fill the gap between the adjacent partial magnetic layers 40*a*.

In the magnetic layers 7*a* and 7*b*, the area of the partial magnetic layer 40*b* is larger than that of the partial magnetic layer 40*a*. Namely, the area of contact between the partial magnetic layer 40*b* and the magnetic layer 5*a* is larger than the area of contact between the partial magnetic layer 40*a* and the magnetic layer 4*h*. In addition, the area of the partial magnetic layer 50*a* is larger than that of the partial magnetic layer 50*b*. Namely, the area of contact between the partial magnetic layer 50*a* and the magnetic layer 4*h* is larger than the area of contact between the partial magnetic layer 50*b* and the magnetic layer 5*a*.

Further, a dielectric material or insulator may be used instead of the magnetic layers 4*a* to 4*h*, 5*a* to 5*f*, 6*a*, 6*b*, 7*a*, and 7*b* composed of ferrite. Hereinafter, when the magnetic layers 4*a* to 4*h*, 5*a* to 5*f*, 6*a*, 6*b*, 7*a*, and 7*b*, and the coil electrodes 8*a* to 8*n* are individually described, alphabet is added to each reference numeral. When the magnetic layers 4*a* to 4*h*, 5*a* to 5*f*, 6*a*, 6*b*, 7*a*, and 7*b*, and the coil electrodes 8*a* to 8*n* are generically named, the alphabet behind each reference numeral is omitted. In addition, when the via hole conductors B1 to B15 are individually described, a numeral is added behind alphabet B, and when the via hole conductors B1 to B15 are generically named, the numeral behind alphabet B is omitted.

Each of the coil electrodes 8 is composed of a conductive material including Ag and has a partially cut-away ring shape. In this embodiment, each of the coil electrodes 8 has a U-like shape. Therefore, each of the coil electrodes 8 constitutes an electrode having a length of ¾ turn. As shown in FIG. 2, the coil electrodes 8*a* and 8*n* are extended to the short sides of the magnetic layers 4*a* and 5*f*, respectively. The purpose of this is to connect the coil L and the external electrodes 12*a* and 12*b*. The coil electrodes 8 may be composed of a conductive material such as a noble metal containing Pd, Au, Pt, or the like as a main component or an alloy thereof, or the like. The coil electrodes 8 may be formed in a partially cut-away circular or elliptic shape.

Next, the via hole conductors B are described. The via hole conductors B are formed to pass through the magnetic layers 4, 5, and 7 in the vertical lamination direction in order to connect together the coil electrodes 8. Therefore, the coil electrodes 8 constitute the helical coil L.

In an exploded perspective view of FIG. 2, the magnetic layer 6*a*, the magnetic layers 4*a* to 4*h*, the magnetic layers 7*a* and 7*b*, the magnetic layers 5*a* to 5*f*, and the magnetic layer 6*b* are laminated in that order from above in the lamination direction to form the laminate 2. In addition, the external electrodes 12*a* and 12*b* are formed on the surface of the laminate 2 to produce the multilayer electronic component 1 shown in FIG. 1.

Figure 3:
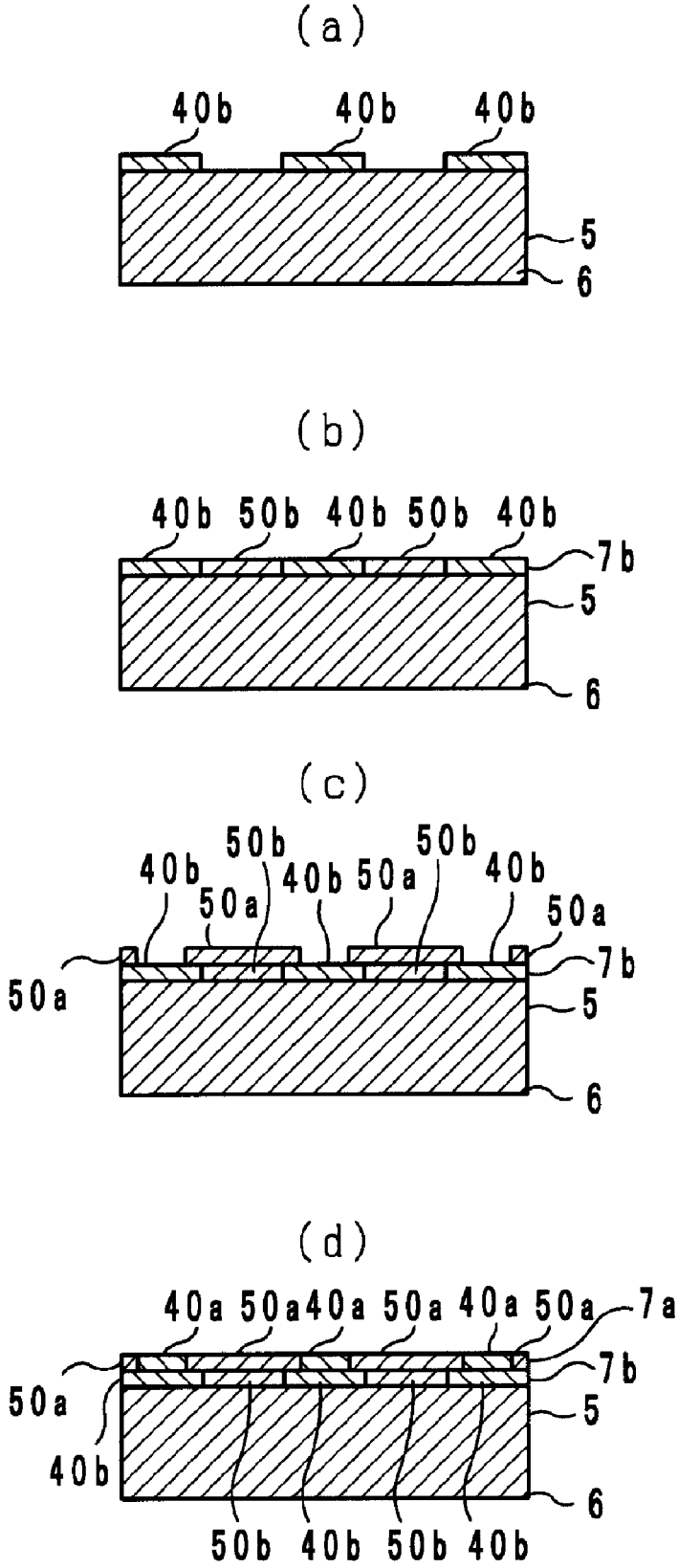
FIG. 3 is a process sectional view of a multilayer electronic component.

The method for manufacturing the multilayer electronic component 1 is described below with reference to FIGS. 2 and 3. FIG. 3 is a sectional view of the steps for the multilayer electronic component 1. In the manufacturing method described below, the multilayer electronic component 1 is formed by combining a sheet lamination method and a printing method.

A ceramic green sheet serving as each of the magnetic layers 4 and 6*a* is formed as follows:

Ferric oxide ($Fe_2O_3$), zinc oxide (ZnO), nickel oxide (NiO), and copper oxide (CuO) are weighed as raw materials at a predetermined ratio and charged in a ball mill, followed by wet mixing. The resultant mixture is dried and then ground, and the resultant powder is calcined at 800° C. for 1 hour. The resultant calcined powder is wet-ground in a ball mill, dried, and then disintegrated to prepare a ferrite ceramic powder having a particle diameter of 2 μm.

Then, a binder (e.g., vinyl acetate, water-soluble acryl, or the like), a plasticizer, a wetting material, and a dispersant are added to the ferrite ceramic powder and mixed in a ball mill, and the resultant mixture is degassed under reduced pressure. The resultant ceramic slurry is formed in a sheet by a doctor blade method and then dried to form a ceramic green sheet having a predetermined thickness of for example, 40 μm.

Next, a ceramic green sheet serving as each of the magnetic layers 5 and 6*b* is formed as follows. Ferric oxide ($Fe_2O_3$), zinc oxide (ZnO), nickel oxide (NiO), and copper oxide (CuO) are weighed as raw materials at a predetermined ratio and charged in a ball mill, followed by wet mixing. In this case, zinc oxide (ZnO) is mixed at a slightly lower ratio, and nickel oxide (NiO) is mixed at a slightly higher ratio. The resultant mixture is dried and then ground, and the resultant powder is calcined at 800° C. for 1 hour. The resultant calcined powder is wet-ground in a ball mill, dried, and then disintegrated to prepare a ferrite ceramic powder having a particle diameter of 2 μm.

Then, a binder (e.g., vinyl acetate, water-soluble acryl, or the like), a plasticizer, a wetting material, and a dispersant are added to the ferrite ceramic powder and mixed in a ball mill, and the resultant mixture is degassed under reduced pressure. The resultant ceramic slurry is formed in a sheet by a doctor blade method and then dried to form a ceramic green sheet having a predetermined thickness of, for example, 40 μm.

The via hole conductors B are formed in the respective ceramic green sheets serving as the magnetic layers 4*a* to 4*h* and 5*a* to 5*e*. Specifically, through holes are formed in the respective ceramic green sheets using a laser beam. Next, the through holes are filled with a conductive paste such as Ag, Pd, Cu, or Au or an alloy thereof by a method such as print coating or the like.

Next, a conductive paste composed of Ag, Pd, Cu, or Au or an alloy thereof as a main component is applied to each of the ceramic green sheets serving as the magnetic layers 4*a* to 4*h* and 5*a* to 5*f* by a method such as a screen printing method, a photolithographic method, or the like to form the coil electrodes 8. The coil electrodes 8 and the via hole conductors B may be simultaneously formed on each of the ceramic green sheets.

Next, the ceramic green sheets are laminated. Specifically, the ceramic green sheet serving as the magnetic layer 6*b* is disposed. Next, the ceramic green sheet serving as the magnetic layer 5*f* is disposed and temporarily pressure-bonded to the ceramic green sheet serving as the magnetic layer 6*b*. Then, similarly the ceramic green sheets serving as the magnetic layers 5*e*, 5*d*, 5*c*, 5*b*, and 5*a* are disposed in that order and temporarily pressure-bonded.

Next, layers serving as the magnetic layers 7*b* and 7*a* are formed on the ceramic green sheet serving as the magnetic layer 5*a* by a printing method. This method is described below with reference to FIG. 3. Hereinafter, the green partial magnetic layers 40*a*, 40*b*, 50*a*, and 50*b* are referred to as the partial magnetic layers 40*a*, 40*b*, 50*a*, and 50*b* for simplifying description.

First, as shown in FIG. 3(*a*), a paste composed of the same material as the magnetic layers 4 is applied on the magnetic layer 5 by a screen printing method to form the partial magnetic layer 40*b*. In this case, the partial magnetic layer 40*b* is not formed in a portion where the via hole conductor B1 is to be formed. Next, as shown in FIG. 3(*b*), a paste composed of the same material as the magnetic layers 5 is applied to portions, in which the partial magnetic layer 40*b* is not formed on the magnetic layer 5, by a screen printing method to form the partial magnetic layer 50*b*. Then, the via hole conductor B10 is formed by filling a conductive paste in the portion where the partial magnetic layer 40*b* is not formed.

Next, as shown in FIG. 3(*c*), a paste composed of the same material as the magnetic layers 5 is applied on the magnetic layer 7*b* by a screen printing method to form the partial magnetic layer 50*a*. In this case, the partial magnetic layer 50*a* is formed to completely cover the partial magnetic layer 50*b*. Next, as shown in FIG. 3(*d*), a paste composed of the same material as the magnetic layers 4 is applied to portions, in which the partial magnetic layer 50*a* is not formed on the magnetic layer 7*b*, by a screen printing method to form the partial magnetic layer 40*a*. The partial magnetic layer 40*a* is formed on the partial magnetic layer 40*b* to be smaller than the partial magnetic layer 40*b*. Further, the partial magnetic layer 40*a* is not formed in a portion in which the via hole conductor B9 is to be formed. Then, the via hole conductor B9 is formed by filling a conductive paste in the portion where the partial magnetic layer 40*a* is not formed.

Next, the ceramic green sheets serving as the magnetic layers 4*h*, 4*g*, 4*f*, 4*e*, 4*d*, 4*c*, 4*b*, 4*a*, and 6*a* are laminated in that order and temporarily pressure-bonded to the ceramic green sheet serving as the magnetic layer 7*a*. As a result, the green laminate 2 is formed. The green laminate 2 is subjected to main pressure-bonding by hydrostatic pressure pressing or the like.

Next, the laminate 2 is subjected to binder removal and firing. The binder removal is performed under conditions, for example, at 400° C. for 3 hours. The firing is performed under conditions, for example, at 900° C. for 2 hours. As a result, the fired laminate 2 is prepared. Then, an electrode paste containing silver as a main component is applied by, for example, a method such as dipping or the like and baked on the surface of the laminate 2 to form the external electrodes 12*a* and 12*b*. As shown in FIG. 1, the external electrodes 12*a* and 12*b* are formed on the right and left end surfaces of the laminate 2. The coil electrodes 8*a* and 8*n* are electrically connected to the external electrodes 12*a* and 12*b*, respectively.

Finally, Ni plating/Sn plating is performed on the surfaces of the external electrodes 12*a* and 12*b*. The multilayer electronic component 1 shown in FIG. 1 is completed through the above-described steps.

(Effect)

In the above-described multilayer electronic component 1, in the magnetic layers 7*a* and 7*b* disposed between the laminate of the magnetic layers 4 and the laminate of the magnetic layers 5, the partial magnetic layers 40*a* and 50*a* are disposed to be adjacent to each other in a plane, and the partial magnetic layers 40*b* and 50*b* are disposed to be adjacent to each other in a plane. Therefore, the partial magnetic layer 40*a* and the partial magnetic layer 50*a* are in contact with each other through the sides, and the partial magnetic layer 40*b* and the partial magnetic layer 50*b* are in contact with each other through the sides. As a result, the contact area between magnetic layers of different materials can be increased, thereby suppressing the occurrence of delamination in the multilayer electronic component 1.

Further, in the multilayer electronic component 1, the area of the partial magnetic layer 50*b* is smaller than the area of the partial magnetic layer 50*a*, and the area of the partial magnetic layer 40*a* is smaller than the area of the partial magnetic layer 40*b*. As described below, therefore, the occurrence of delamination in the multilayer electronic component 1 can be effectively suppressed.

As shown in FIG. 3, for example, the bottom surface of the partial magnetic layer 50*b* is in contact with the magnetic layer 5*a*, and the top surface thereof is in contact with the partial magnetic layer 50*a*. In addition, the top surface of the partial magnetic layer 50*a* is in contact with the magnetic layer 4*h*. The partial magnetic layer 50*a* and the magnetic layer 4*h* are composed of different materials, and the partial magnetic layers 50*a* and 50*b* and the magnetic layer 5*a* are composed of the same material. Therefore, the bonding strength between the partial magnetic layer 50*a* and the magnetic layer 4*h* is smaller than that between the partial magnetic layer 50*a* and the partial magnetic layer 50*b* and between the partial magnetic layer 50*b* and the magnetic layer 5*a*. Thus, when delamination possibly occurs in the multilayer electronic component 1, delamination tends to occur between the partial magnetic layer 50*a* and the magnetic layer 4*h* or between the partial magnetic layer 50*b* and the magnetic layer 5*a*.

However, since the partial magnetic layer 50*a* is formed to be larger than the partial magnetic layer 50*b*, the bottom surface of the partial magnetic layer 50*a* partially overlaps the top surface of the partial magnetic layer 40*b*. In addition, since the partial magnetic layer 40*b* is formed to be larger than the partial magnetic layer 40*a*, the top surface of the partial magnetic layer 40*b* partially overlaps the bottom surface of the partial magnetic layer 50*a*. As a result, the occurrence of delamination in the multilayer electronic component 1 can be effectively suppressed.

In addition, the partial magnetic layer 40*b* and the partial magnetic layer 50*b* are arranged in a checked pattern so that the partial magnetic layer 40*b* and the partial magnetic layer 50*b* are in contact with each other through the side surfaces in a wider area. As a result, the area of contact between magnetic layers of different materials can be increased, and the occurrence of delamination in the multilayer electronic component 1 can be effectively suppressed.

In the multilayer electronic component 1, the magnetic layers 7*a* and 7*b* composed of the same materials as the magnetic layers 4 and 5 are provided in the boundary between the laminate of a plurality of the magnetic layers 4 and the laminate of a plurality of the magnetic layers 5, thereby suppressing the occurrence of delamination in the multilayer electronic component 1. Namely, a layer composed of a new material for bonding these laminates is not provided. Consequently, the multilayer electronic component 1 causing little delamination can be manufactured at low cost.

In addition, the partial magnetic layer 40*b* and the magnetic layer 5*a* composed of different materials are formed by a printing method. Therefore, the adhesion between the partial magnetic layer 40*b* and the magnetic layer 5*a* is improved as compared with the case in which the partial magnetic layer 40*b* and the magnetic layer 5*a* are formed by a sheet lamination method.

Further, the magnetic layers 4 and 5 with the coil electrodes 8 formed thereon are laminated by the sheet laminating method. Therefore, the length of the coil L may be changed only by adding new magnetic layers 4 and 5 with the electrodes 8 formed thereon. As a result, in the multilayer electronic component 1, the length of the coil L can be easily changed as compared with the case in which the magnetic layers 4 and 5 with the coil electrodes 8 formed thereon are laminated by the printing method.

Figure 4:
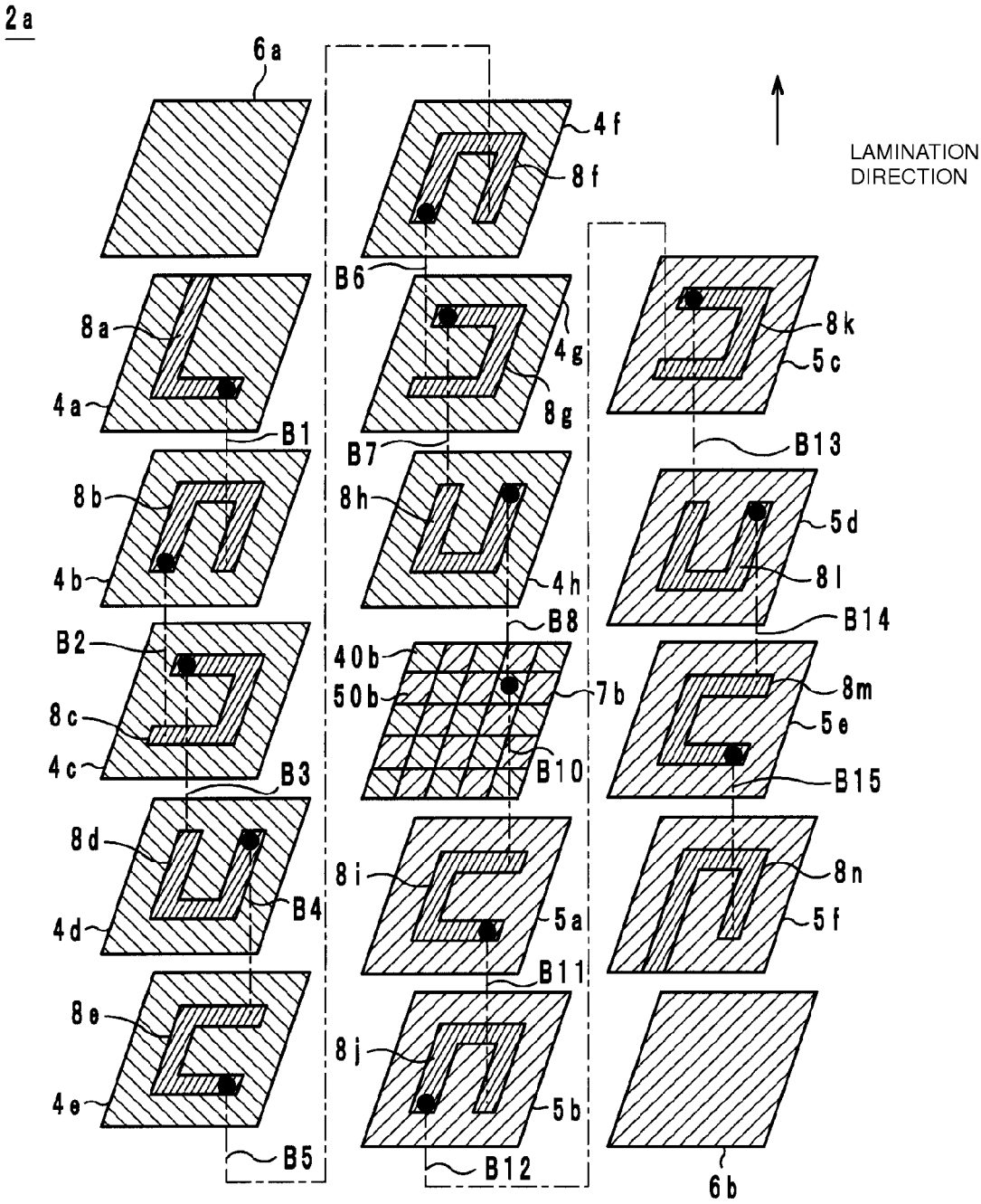
FIG. 4 is an exploded perspective view of a laminate of a multilayer electronic component according to a modified example.

In addition, the multilayer electronic component 1 is not limited to the above-described embodiment, and modifications can be made within the scope of the gist. FIG. 4 is an exploded perspective view of a laminate 2*a* of a multilayer electronic component 1*a* according to a modified example. In the laminate 2*a* shown in FIG. 4, the same configuration as in the laminate 2 shown in FIG. 2 is denoted by the same reference numeral.

The difference between the laminate 2 shown in FIG. 2 and the laminate 2*a* shown in FIG. 4 lies in the point that the magnetic layer 7*a* is provided in the laminate 2, while the magnetic layer 7*a* is not provided in the laminate 2*a*.

In the laminate 2*a*, the partial magnetic layer 40*b* and the partial magnetic layer 50*b* are in contact with each other through the sides thereof. Therefore, the area of contact between magnetic layers of different materials can be increased, thereby suppressing the occurrence of delamination in the multilayer electronic component 1*a*.

Although the multilayer electronic component 1 uses the ¾-turn coil electrodes 8, for example, ⅚-turn coil electrodes 8 or ⅞-turn coil electrodes may be used.

Although, in the method for manufacturing the multilayer electronic component 1, the multilayer electronic component 1 is formed by combining a sheet laminating method and a printing method, the method for manufacturing the multilayer electronic component 1 is not limited to this. For example, the multilayer electronic component 1 may be formed only by a printing method.

In the multilayer electronic components 1 and 1*a*, the expression "composed of different materials" includes the case in which the constituent raw materials are different and the case in which the mixing ratios of the same raw material are different.

As described above, the embodiments consistent with the claimed invention are advantageous for multilayer electronic components and are particularly excellent in that the occurrence of delamination is suppressed.

Although a limited number of embodiments are described herein, one of ordinary skill in the art will readily recognize that there could be variations to any of these embodiments and those variations would be within the scope of the appended claims. Thus, it will be apparent to those skilled in the art that various changes and modifications can be made to the communication system described herein without departing from the scope of the appended claims and their equivalents.

The invention claimed is:

1. A multilayer electronic component comprising:

a first insulating layer of a first material;

a second insulating layer of a second material different from the first material; and a boundary layer provided between the first insulating layer and the second insulating layer and including a first partial layer of the first material and a second partial layer of the second material, wherein the first partial layer and the second partial layer are positioned adjacent to each other as viewed in a lamination direction, the first material of the first partial layer is in contact with the first material of the first insulating layer in the lamination direction and with the second material of the second insulating layer in a direction opposite to the lamination direction, and the second material of the second partial layer is in contact with the first material of the first insulating layer in the lamination direction and with the second material of the second insulating layer in a direction opposite to the lamination direction.

2. The multilayer electronic component according to claim 1, wherein the first partial layer is provided so that the contact area with the second insulating layer is larger than the contact layer with the first insulating layer.

3. The multilayer electronic component according to claim 2, wherein the boundary layer comprises:

a first boundary layer provided on the first insulating layer side; and a second boundary layer provided on the second insulating layer side, the area of the first partial layer provided in the second boundary layer being larger than the area of the first partial layer provided in the first boundary layer.

4. The multilayer electronic component according to claim 1, further including a plurality of said first insulating layer and a plurality of said second insulating layer, said a plurality of the first insulating layer being laminated to form a first laminate, and said plurality of the second insulating layer being laminated to form a second laminate.

5. The multilayer electronic component according to claim 4, wherein the first laminate and the second laminate include a coil.

6. The multilayer electronic component according to claim 5, wherein the first partial layer and the second partial layer are arranged in a checked pattern in the boundary layer.

7. The multilayer electronic component according to claim 2, further including a plurality of said first insulating layer and a plurality of said second insulating layer, said plurality of the first insulating layer being laminated to form a first laminate, and said plurality of the second insulating layer being laminated to form a second laminate.

8. The multilayer electronic component according to claim 7, wherein the first laminate and the second laminate include a coil.

9. The multilayer electronic component according to claim 8, wherein the first partial layer and the second partial layer are arranged in a checked pattern in the boundary layer.

10. The multilayer electronic component according to claim 3, further including a plurality of said first insulating layer and a plurality of said second insulating layer, said plurality of the first insulating layer being laminated to form a first laminate, and said plurality of the second insulating layer being laminated to form a second laminate.

11. The multilayer electronic component according to claim 10, wherein the first laminate and the second laminate include a coil.

12. The multilayer electronic component according to claim 11, wherein the first partial layer and the second partial layer are arranged in a checked pattern in the boundary layer.

13. A multilayer electronic component comprising:

a first insulating layer composed of a first material;

a second insulating layer composed of a second material different from the first material; and a boundary layer provided between the first insulating layer and the second insulating layer and including a first partial layer composed of the first material and a second partial layer composed of the second material, wherein the first partial layer and the second partial layer are positioned adjacent to each other as viewed in a lamination direction, wherein the first partial layer and the second partial layer are arranged in a checked pattern in the boundary layer.

14. The multilayer electronic component according to claim 13, wherein the first partial layer is provided so that the contact area with the second insulating layer is larger than the contact layer with the first insulating layer.

15. The multilayer electronic component according to claim 13, wherein the boundary layer comprises:

a first boundary layer provided on the first insulating layer side; and a second boundary layer provided on the second insulating layer side, the area of the first partial layer provided in the second boundary layer being larger than the area of the first partial layer provided in the first boundary layer.

16. The multilayer electronic component according to claim 13, further including a plurality of said first insulating layer and a plurality of said second insulating layer, said a plurality of the first insulating layer being laminated to form a first laminate, and said plurality of the second insulating layer being laminated to form a second laminate.

17. The multilayer electronic component according to claim 16, wherein the first laminate and the second laminate include a coil.

* * * * *